US006489942B1

(12) United States Patent
Chiba

(10) Patent No.: US 6,489,942 B1
(45) Date of Patent: Dec. 3, 2002

(54) LIQUID CRYSTAL DISPLAY DEVICE

(75) Inventor: Shinsaku Chiba, Mobara (JP)

(73) Assignee: Hitachi, Ltd., Tokyo (JP)

( * ) Notice: Subject to any disclaimer, the term of this patent is extended or adjusted under 35 U.S.C. 154(b) by 100 days.

(21) Appl. No.: 09/613,752

(22) Filed: Jul. 11, 2000

(30) Foreign Application Priority Data

Jul. 30, 1999 (JP) ..... 11-216198

(51) Int. Cl.[7] ..... G09G 3/36

(52) U.S. Cl. ..... 345/98; 345/94; 345/95; 345/90; 345/99; 345/97; 345/100; 345/204; 345/212; 345/214

(58) Field of Search ..... 345/98, 99, 100, 345/204, 214, 94, 95, 90, 212, 97

(56) References Cited

U.S. PATENT DOCUMENTS 5,754,152 A * 5/1998 Nakamura et al. ..... 345/94
6,195,077 B1 * 2/2001 Gyouten et al. ..... 345/99
6,369,791 B1 * 4/2002 Kudo et al. ..... 345/100

* cited by examiner

*Primary Examiner*—Richard Hjerpe
*Assistant Examiner*—Nguyen T. Jennifer

(57) ABSTRACT

A liquid crystal display device includes visual display elements, a data electrode driver circuit, a power supply circuit, and a correction pulse generator circuit for generation of correction-for-compensation pulses. The data electrode driver circuit includes a voltage application circuit and a voltage selector circuit for selecting a correction voltage when more than one display element is turned on and a non-select voltage when a display element is turned off. The voltage application circuit applies the correction voltage as output from the voltage selector circuit to a data electrode with display data changing from "0" to "1" or alternatively from "1" to "0" when the display element is turned on, which permits inputting from the correction pulse generator circuit, and the voltage application circuit applies the non-select voltage as output from the voltage selector circuit when the display element is turned off.

12 Claims, 10 Drawing Sheets

Some Major Voltage Waveforms in the Case of Performing White Displaying

Waveform Distortion of Segment Driver Output

Waveform of Drive Voltage

LIQUID CRYSTAL DISPLAY DEVICE

BACKGROUND OF THE INVENTION

The present invention relates generally to liquid crystal display devices and, more particularly, to a technique adaptable for use with segment drivers in liquid crystal display devices of the simple matrix type.

Simple matrix type liquid crystal display devices such as liquid crystal display modules of super twisted nematic (STN) schemes for example are widely employed as display devices for use in notebook personal computers (PCs) and others.

FIG. 6 is a diagram showing a configuration of equivalent circuitry of a prior known liquid crystal display panel of presently available STN liquid crystal display modules along with peripheral circuitry.

The liquid crystal display panel is designated by numeral 101 and is designed to include a pair of glass substrates spatially opposing each other with a layer of liquid crystal disposed therebetween, wherein one glass substrate has its liquid crystal side surface on a plurality of parallel common electrodes 11 which are formed in such a manner that these extend in a direction "X" and laid out in a direction "Y" with each of the plurality of common electrodes 11 being connected to a corresponding one of common drivers as provided in a common driver unit 103.

The other glass substrate has a liquid crystal side surface on which a plurality of parallel segment electrodes 10 are formed in a manner such that they extend in the direction Y and arrayed in the direction X with each of the plurality of segment electrodes 10 being connected to a corresponding one of segment drivers in a common driver unit 102.

The plurality of segment electrodes and the plurality of common electrodes intersect each other at crossover points, each of which constitutes a picture element or "pixel" region, wherein the pixels are driven by applying drive voltages from respective segment drivers of said segment driver unit 102 to said plurality of segment electrodes 10 while applying drive voltages from respective common drivers of said common driver unit 103 to said plurality of common electrodes 11.

Simple-matrix liquid crystal display devices are typically driven with time-division methods, one of which is the so-called line-sequential driving method that includes the steps of sequentially selecting one by one the common electrodes (or scan electrodes) within a single scanning time period and then applying a drive voltage to each pixel of the liquid crystal within this select period.

The line-sequential drive methodology typically includes an "Alt Pleshko" drive method (also known as smart addressing or HIFAS) and a standard drive method (called a voltage averaging method), both of which are well known among those skilled in the art to which the invention pertains.

Another method, called the alternate current (AC) drive method, is also employable which includes the step of inverting periodically, i.e. once per specified period, respective drive voltages applied to said plurality of segment electrodes and said plurality of common electrodes.

In the Alt Pleshko drive method, when an alternate current signal (M) is at High (simply referred to as "H" hereinafter) level, a drive voltage of Vsh is applied to each segment electrode of data "1" while letting a drive voltage of Vsl be applied to each segment electrode of data "0" as an example shown in FIG. 7.

In addition, a drive voltage of Vcl is applied to a selected common electrode while simultaneously a drive voltage of Vm is applied to non-select common electrodes.

Note here that the drive voltage of Vm is applied to such non-select common electrodes irrespective of whether the alternate current signal (M) is at H level or Low ("L") level.

Furthermore, when the alternate current signal (M) is at L level, the drive voltage of Vsl is applied to each segment electrode of data "1" while the drive voltage of Vsh is applied to each segment electrode of data "0" as an example shown in FIG. 7.

Additionally a drive voltage of Vch is applied to a common electrode presently selected.

Note that FIG. 7 shows some major voltage waveforms in the case of performing white displaying, wherein these drive voltages are to be supplied by a power supply circuitry. =p An equivalent circuitry of the STN liquid crystal display panel may be represented by a circuit shown in FIG. 6, which is considered as a circuit with liquid crystal capacitors (CLC) being formed at intersections between the segment electrodes 10 and the common electrodes 11.

However, in the event that both the segment electrodes 10 and common electrodes 11 change or vary in potential level of the voltages being applied thereto, waveform rounding deformation or distortion will always occur in such applied voltages with no exceptions due to a relation of electrical interconnect lead resistivities of the segment electrodes 10 and common electrodes 11 versus the liquid crystal capacitors (CLC), as in a voltage waveform that is applied to a segment electrode 10 shown in FIG. 8 as an example.

Such waveform distortion would result in a decrease in effective value of a voltage as applied to each pixel upon changing of its potential level-for example, in liquid crystal display panels of the normally-off type, the effective voltage reduction leads to an appreciable decrease in brightness of those images being visually displayed at corresponding locations on a panel screen.

The description of the phenomenon stated above will be collectively referred to as the "shadowing" hereafter.

Once this shadowing takes place at specific lines on the screen of a liquid crystal display panel, the resultant display image contains black fine stripe-shaped noises viewable like hair-lines to human eyes, which results in a significant decrease in quality of images displayed on the screen of such liquid crystal display panel.

Prior known remedies for such a problem include a method shown in FIGS. 9 to 11 or another method shown in FIGS. 12–14.

The shadowing correction/compensation method shown in FIGS. 9–11 is that, as shown in FIG. 10, a time point at which a drive voltage being applied to a segment electrode(s) 10 while changes in potential level are detected by an exclusive logical sum circuit (EXOR) to which a presently incoming data and its preceding data are inputted. Then an AND circuit (AND1) is used to obtain a logical product between an output of the exclusive logical sum circuit (EXOR) and a correction pulse thereby causing a correction-for-compensation signal to stay at H level within a time period in which the correction pulse is at H level.

As shown in FIG. 9, when this correction signal stays at H level, an output of an AND circuit (AND1) is set at L level while an output of a NAND circuit (NAND1) is forced to be at H level, which thereby causes both an N type MOS transistor (simply referred to as "NMOS" hereinafter) (NM1) and a P type MOS transistor (simply referred to as "PMOS" hereafter) (PM1) to turn off.

Alternatively, when the correction signal is at H level, either a PMOS (PM2) or NMOS (NM2) are turned on the basis of this correction signal and the present data value.

Whereby, when the correction signal is at H level, a drive voltage of either Vshh or Vsll is applied to the segment electrode.

In short, this method applies a pulse-like correction voltage (e.g. pulses 15 of FIG. 11) when the drive voltage being applied to a segment electrode 10 changes in potential level in order to ensure that an effective voltage applied to a pixel when the drive voltage applied to the segment electrode 10 becomes identical to an effective voltage applied to the pixel so that the drive voltage as applied to segment electrode 10 does not change in potential level as shown in FIG. 11.

It should be noted in FIG. 9 that a DISPOFF signal is set to control on and off of the liquid crystal display panel, wherein the liquid crystal display panel is driven to display images on its screen when the DISPOFF signal stays at H level, and no images are displayed on the liquid crystal display panel when the DISPOFF signal is at L level.

More specifically, when this DISPOFF signal is at L level, the PMOS (PM1) and NMOS (NM1) turn off whereas PMOS (PM3) and NMOS (NM3) turn on, which causes a non-select voltage (Vm) to be applied to segment electrodes.

Another prior art shadowing correction/compensation method is shown in FIGS. 12–14. As shown in FIG. 13, a time point at which a drive voltage being applied to a segment electrode 10 is kept unchanged in potential level which is detected by a coincidence circuit (AGR) with the presently incoming data and its preceding data being input thereto; then, an AND circuit (AND1) is used to gain a logical product between an output of the coincidence circuit (AGR) and a correction pulse thereby a correction-for-compensation signal is caused to stay at H level when the correction pulse is at H level.

As shown in FIG. 12, when this correction signal stays at H level, an output of AND circuit (AND2) is at L level while an output of NAND circuit (NAND1) is forced to be at H level, which causes NMOS (NM1) and PMOS (PM1) to turn off. Alternatively, when the correction signal is at H level, PMOS (PM3) and NMOS (NM3) turn on.

Whereby, when the correction signal is at H level, the non-select voltage (Vm) is applied to segment electrodes.

In short, as shown in FIG. 14, this method applies the non-select voltage (Vm) (e.g. pulses 16 of FIG. 14) to more than one segment electrode when the drive voltage applied to such segment electrode remains unchanged in potential level, thereby reducing any voltage as applied to pixels when the drive voltage being applied to the segment electrode is kept unchanged in potential level in order to guarantee that when an effective voltage applied to pixels the drive voltage applied to the segment electrode does not change in potential level, which is identical to an effective voltage being applied to the pixel while the drive voltage as applied to the segment electrode has actually changed in potential level.

However, while the shadowing correction method shown in FIGS. 9–11 offers successful shadowing correctability, this advantage does come with a price of two separate transistors, e.g. PMOS (PM2) and NMOS (NM2), as output stage transistors in applying drive voltages of (Vshh, Vsll) to the segment electrodes 10.

The need to employ these PMOS (PM2) and NMOS (NM2) would disadvantageously result in an increase in chip area to accommodate large currents, which in turn leads to an increase in segment driver areas thus increasing production costs.

The shadowing correction method shown in FIGS. 12–14 although does not take the PMOS (PM2) and NMOS (NM2) as in the method shown in FIGS. 9–11, it needs a potential change in output voltages which results in an increase in frequency components of voltages so as to decrease the efficiency of the shadowing correction/compensation.

SUMMARY OF THE INVENTION

The present invention has been made in order to avoid the problems faced with the prior art, and a primary objective of the invention is to provide a technique adaptable for use in liquid crystal display devices to prevent degradation of display images otherwise occurring due to waveform rounding deformation or distortion of drive voltages as applied to data lines without having to increase the area of a semiconductor chip or chips in data line driver means.

To attain the object, the invention provides a liquid crystal display device which includes a plurality of scan electrodes, display elements that oppose the plurality of scan electrodes with a layer of liquid crystal disposed therebetween and have a plurality of data electrodes crossing or intersecting at right angles with the plurality of scan electrodes, data electrode driver means for applying to the plurality of data electrodes any voltage corresponding to the display data and the non-select voltage as well as a correction-for-compensation voltage with a potential difference relative to the non-select voltage being greater than a potential difference between the voltage corresponding to the display data and the non-select voltage, a power supply circuit for supplying the data electrode driver means with the above-noted voltage corresponding to the display data and the non-select voltage plus the compensation voltage, and a compensation pulse generator circuit for generation of more than one compensation pulse, wherein the data driver means includes voltage selector means for selecting the compensation voltage when the non-select voltage and compensation voltage are inputted thereto with the display elements being rendered operative or turned on and for selecting the non-select voltage within a time period in which the display elements are turned off, and voltage application means, for applying the compensation voltage as output from the voltage selector means to a specified data electrode(s) whereat the display data has changed from "0" to "1" or alternatively from "1" to "0" within the period in which the display elements are turned on and also within a time period in which input is made from the compensation pulse generator circuit and for applying the non-select voltage being output from the voltage selector means within a time period in which the display elements are turned off.

Another principal feature of the instant invention is that the voltage selector means is operable to select either the compensation voltage or the non-select voltage on the basis of a control signal to control on and off of the display elements.

A further feature of the invention is that the device further includes a logical product circuit as provided in a respective one of the data electrodes for determination through digital computation of a logical product of a presently generated display data and the inverted value of its preceding display data as well as the compensation pulse as input from the compensation pulse generator means and for outputting a compensation signal, and that the voltage application means is operable to apply either one of the compensation voltage and the non-select voltage to each data electrode on the basis of the compensation signal as output from the logical product circuit and also a control signal to control on and off of the display elements.

BRIEF DESCRIPTION OF THE DRAWINGS

FIG. 15, FIGS. 15A–15D, are circuit diagrams showing an actually implemented circuit configuration of an exclusive logical sum circuit.

DETAILED DESCRIPTION OF THE PREFERRED EMBODIMENTS

Figure 1:
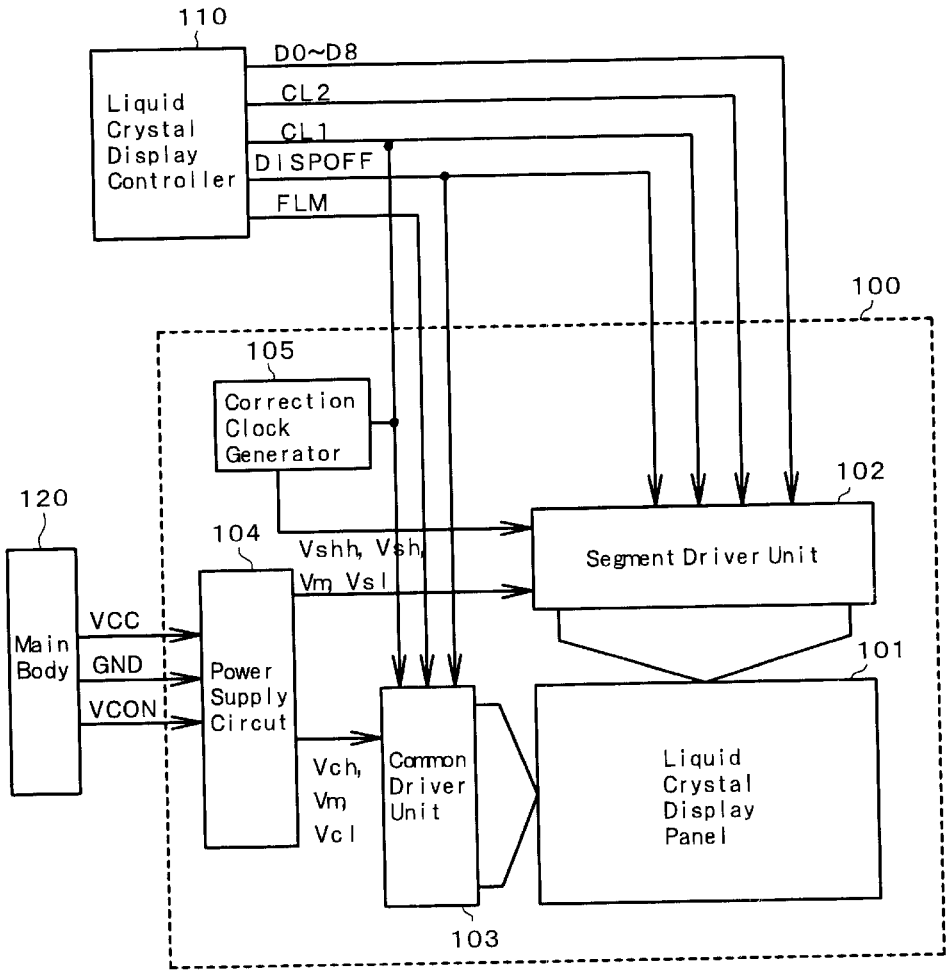
FIG. 1 is a block diagram schematically showing a configuration of a liquid crystal display module (LCM) of the simple matrix type employing STN schemes in accordance with an embodiment 1 of the present invention.

One preferred embodiment of the present invention will now be explained in detail with reference to the accompanying drawings below.

Note that in all of the attached drawings for explanation of the embodiment, the same reference characters are used to designate the same parts or components with identical functions, and any repetitive explanations will be eliminated herein.

Embodiment 1

FIG. 1 is a block diagram schematically showing a configuration of an STN simple-matrix type liquid crystal display module in accordance with an embodiment 1 of the present invention.

In FIG. 1, reference numeral "100" designates a liquid crystal display module; 110 denotes a liquid crystal display controller; 120 is a display system main body.

Here, the liquid crystal display module 100 is generally constituted from a liquid crystal display panel 101, a segment driver unit 102, a common driver unit 103, a power supply circuit 104, and a correction clock generator circuit 105.

Note that although any specific depiction is eliminated herein, the segment driver unit 102 is configured from a plurality of segment drivers; similarly, the common driver unit 103 includes multiple common drivers.

The liquid crystal controller 110 is operable to supply display data to the segment driver unit 102 on the basis of display data (DO–D8) as transferred from an upper-level computer side or the like.

The liquid crystal controller 110 is also operable to generate and issue display control signals (clock (CL2) clock (CL1), frame signal (FLM), display off signal (DISPOFF)) based on a display control signal as transferred from the upper level computer or the like.

The liquid crystal controller 110 sends forth such display control signals thus generated toward the segment driver unit 102 and common driver unit 103 to thereby control each segment driver and each common driver.

The power supply circuit 104 receives external power supply voltages (VCC, GND) as supplied from the display system main body 120; then, the power supply circuit 104 generates from these external power supply voltages certain drive voltages (Vshh, Vsh, Vm, Vsl, Vch, Vcl) for use in driving picture elements or "pixels."

The power supply circuit 104 supplies the drive voltages (Vshh, Vsh, Vm, Vsl) to each segment driver while supplying drive voltages (Vch, Vm, Vcl) to each common driver.

The power supply circuit 104 also supplies power supply voltages of each segment driver and each common driver.

Note here that in FIG. 1, "VCON" designates a control signal for adjusting potential levels of drive voltages for driving the pixels.

The correction clock generator circuit 105 to which a clock (CL1) is input is operable to output a correction for compensation pulse which is at H level for a prespecified time duration after the clock (CL1) has been input thereto.

Figure 2:
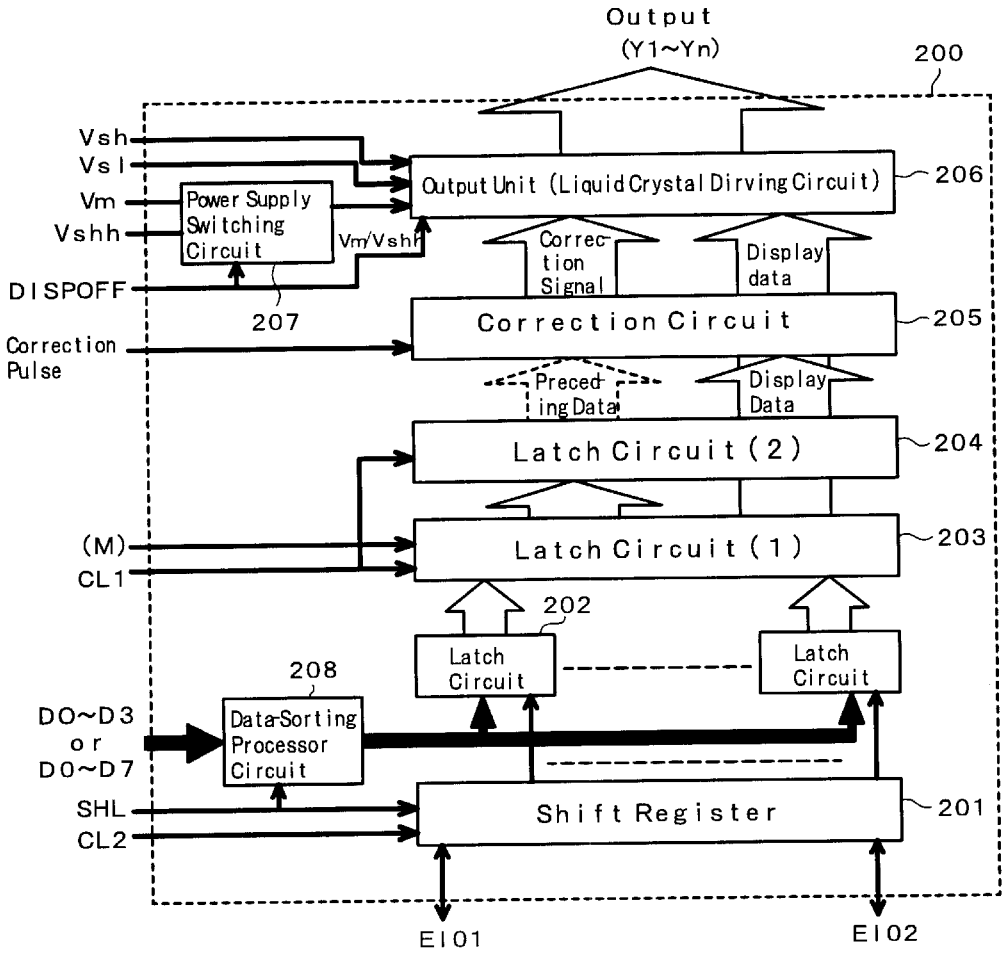
FIG. 2 is a block diagram schematically showing a configuration of one example of each segment driver used in a segment driver unit shown in FIG. 1.

FIG. 2 is a block diagram showing a schematical configuration of one example of each segment driver 200 of the segment driver unit 102 shown in FIG. 1.

In the segment driver 200 shown in the drawing, a shift register 201 is provided for generating a display data fetch/accept pulse on the basis of a display latch clock (CL2) that is input from the liquid crystal controller 110.

Display data as input from the liquid crystal controller 110 is subjected to data sorting and arithmetic processing at a data-sorting/processor circuit 208, wherein display data as output from this data-sorting/processor circuit 208 is then stored in each latch circuit (0) (202) in a way synchronous with a train of display data accept pulses as output from the shift register 201.

The display data being stored in each latch circuit (0) (202) will then be stored in a latch circuit (1) (203) in synchronism with an output timing control clock signal (or alternatively scan electrode shift signal (CL1) which is input from the liquid crystal controller 110.

The display data being stored in each latch circuit (1) (203) will also be stored in a latch circuit (2) (204) in synchronism with the output timing control clock signal (CL1).

The presently available display data are currently stored in this latch circuit (1) (203) and the preceding display data as stored in the latch circuit (2) (204) will then be applied to a correction circuit 205.

In addition the "present" display data as stored in the latch circuit (1) (203) will be applied to an output unit (liquid crystal driving circuit) 206.

A drive voltage of Vm and drive voltage of Vshh, (correction voltage unique to the present invention) are applied to a power supply switching circuit 207; then, the power supply switching circuit 207 operates to selectively output either one of the drive voltage of Vm and drive voltage of Vshh in a way pursuant to a potential level of a display turn-off signal (DISPOFF).

Each common driver of the common driver unit 103 operates to sequentially select at its internal logic circuit a common electrode to be driven once per horizontal scanning time on the basis of the clock (CL1) after inputting of a frame signal (or a first line marker FLM) as input from the liquid crystal controller 110 and also select either a drive voltage of Vch or drive voltage of Vcl in accordance with an alternate current signal (M) to thereby apply it to the selected common electrode while applying the drive voltage of Vm to those common electrodes (non-select common electrodes) other than the selected common electrode.

Figure 3:
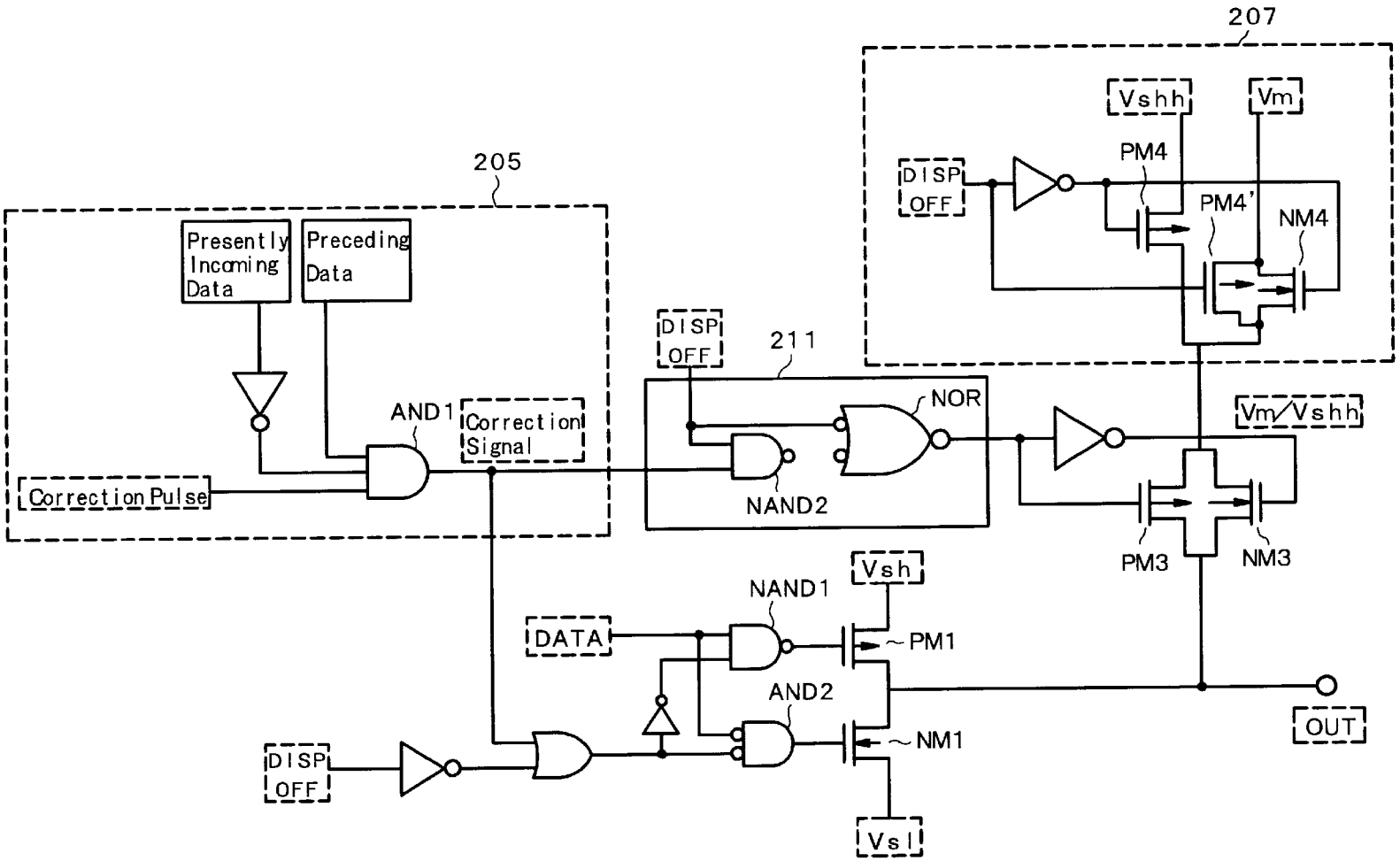
FIG. 3 is a circuit diagram showing a circuit configuration of a compensation circuit and an output unit plus a power supply switcher circuit of the segment driver in accordance with the embodiment of the invention.

FIG. 3 is a circuit diagram showing a circuit configuration of the correction circuit 205, output unit 206 and power supply switching circuit 207 of the segment driver 200 in accordance with the illustrative embodiment.

It should be noted in the same drawing that circuitry within a dotted line frame with numeral "205" added thereto is the correction circuit 205 shown in FIG. 2; similarly, circuitry within a dotted line frame with numeral 207 added is the power supply switching circuit 207 shown in FIG. 2.

Further note that in this drawing, those circuits other than the power supply switching circuit 207 are provided in units of respective segment electrodes 10.

As shown in the drawing the power supply switching circuit 207 is such that when the display off signal (DISPOFF) is at H level a PMOS (PM4) turns on whereas NMOS (NM4) and PMOS (PM4') turn off; alternatively, when the display off signal (DISPOFF) is at L level, PMOS (PM4) turns off whereas NMOS (NM4) and PMOS (PM4') turn on.

Figure 4:
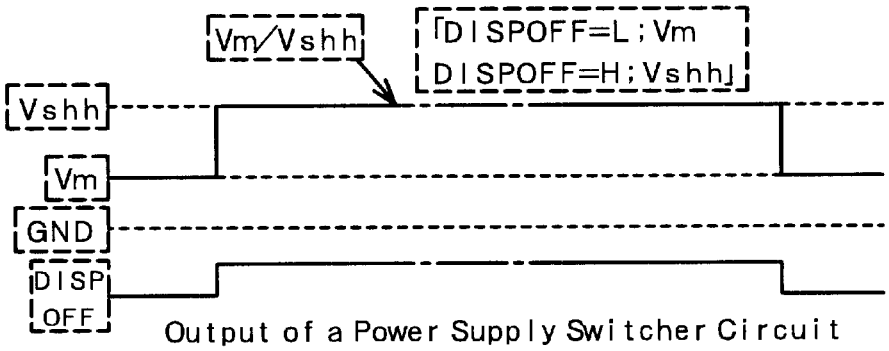
FIG. 4 is a diagram for explanation of some major drive voltages as output from a power supply switcher circuit in the embodiment.

Accordingly, as shown in FIG. 4, the power supply switching circuit 207 operates to output a drive voltage of Vshh when the display off signal (DISPOFF) is at H level; alternatively, when the display off signal (DISPOFF) is at L level, this circuit outputs a drive voltage of Vm.

The correction circuit 205 is designed including an AND circuit (AND1) which is operable to produce a logical product of the present data and the inverted value of its preceding data as well as any correction pulse (s) being input from the correction clock generator circuit 105.

Thus, the correction signal stays at H level only when the correction pulse is at H level in case the present data is at "1" and the preceding data is "0."

A true value table of a logic circuit unit 211 that is configured from a NAND circuit (NAND2) and NOR circuit (NOR) as shown in FIG. 3 is shown in Table 1 below.

TABLE 1

| DISPOFF | Correct. Sig. | Output |
|---|---|---|
| L | * | L |
| H | H | L |
| | L | H |

Note that the symbol "*" as used herein refers to being of no relation with the correction signal.

In the circuitry of FIG. 3, PMOS (PM1) is driven to turn on whereas NMOS (NM1) and PMOS (PM3) plus NMOS (NM3) turn off when the display off signal (DISPOFF) is at H level and the correction signal is at L level while the present display data is at "1", which in turn permits the drive voltage of Vsh to be applied to each segment electrode 10.

Alternatively, when the display off signal (DISPOFF) is set at H level, whereas the correction signal is at L level with the present display data being at "0", the NMOS (NM1) turns on whereas PMOS (PM1), PMOS (PM3) and NMOS (NM3) turn off, thereby a drive voltage of Vsl is applied to each segment electrode 10.

Still alternatively, when the display off signal (DISPOFF) is at H level and the correction signal is at H level, the PMOS (PM3), NMOS (NM3) and PMOS (PM4) turns on while PMOS (PM1) and NMOS (NM1) along with NMOS (NM4) and PMOS (PM4') turn off, thus a drive voltage of Vshh is applied to each segment electrode.

Furthermore, when the display off signal (DISPOFF) is at L level, the PMOS (PM3) and NMOS (NM3) along with NMOS (NM4) and PMOS (PM4') turns on whereas PMOS (PM1) and NMOS (NM1) plus PMOS (PM4) turn off, thus a drive voltage Vm is applied to each segment electrode.

Figure 5:
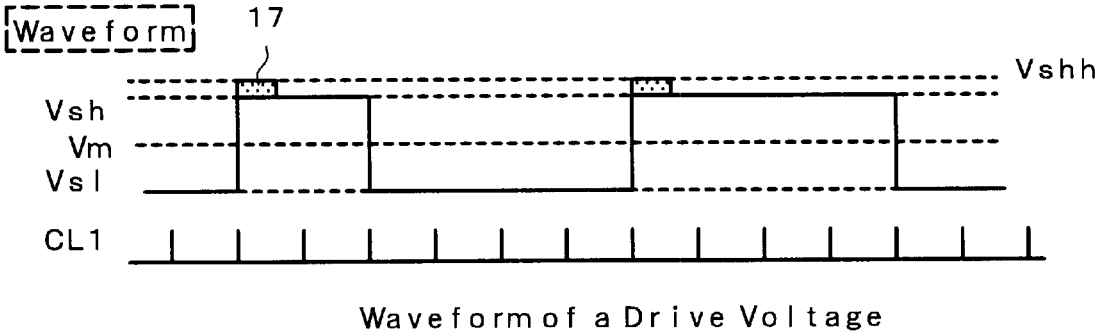
FIG. 5 is a diagram for explanation of a scheme for compensating for possible waveform distortion of a drive voltage as applied to a segment electrode in the embodiment.
Figure 6:
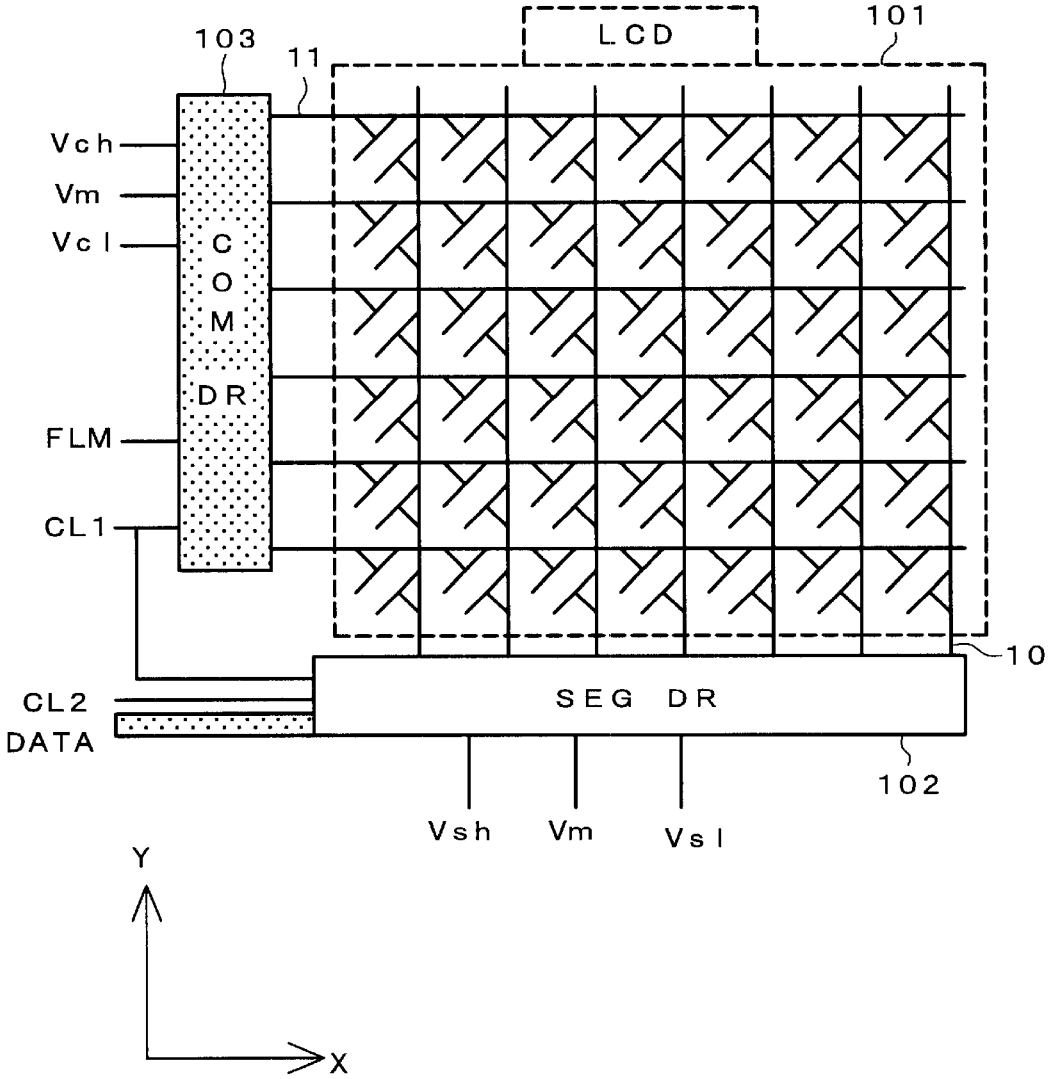
FIG. 6 (Prior Art)
FIG. 6 is a diagram showing a circuit of a liquid crystal display module for use in prior known STN liquid crystal display modules along with a schematic configuration of peripheral circuitry thereof.
Figure 7:
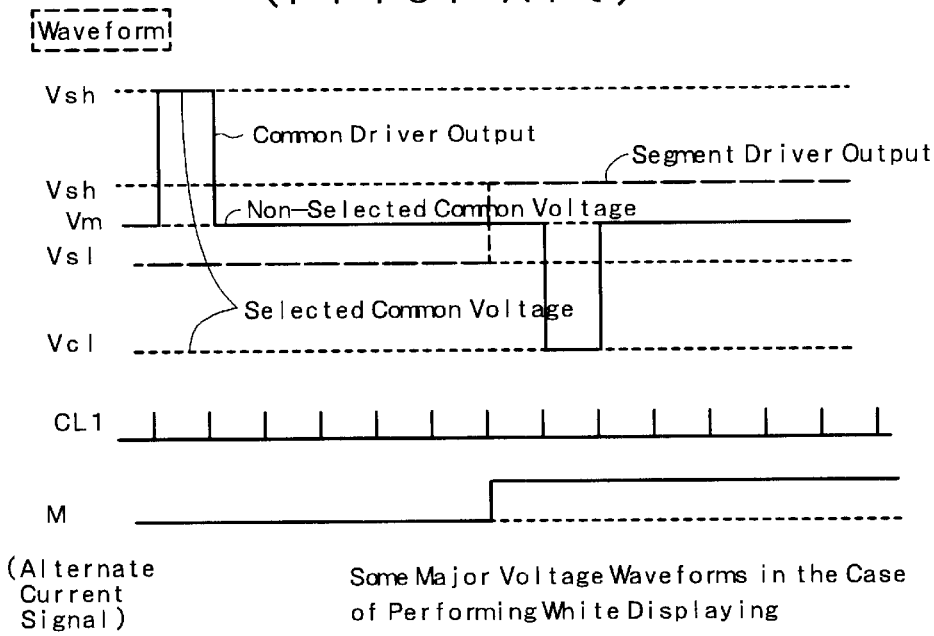
FIG. 7 (Prior Art)
FIG. 7 is a diagram for explanation of a drive voltage being applied to a segment electrode and a drive voltage applied to a common electrode in the so-called "Alt Pleshko" driving method.
Figure 8:
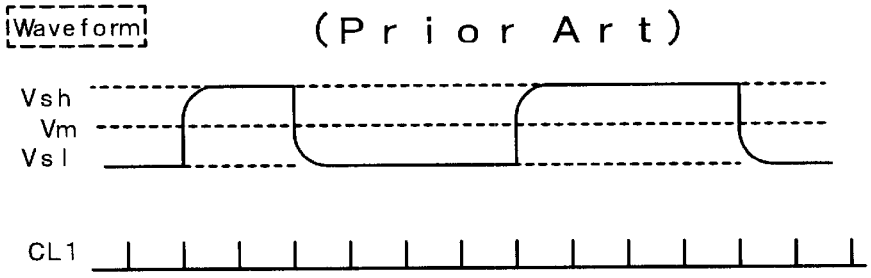
FIG. 8 (Prior Art)
FIG. 8 is a diagram showing an actual voltage waveform as applied to a segment electrode of a liquid crystal display panel.

To be brief, this embodiment is specifically arranged as shown in FIG. 5 to give a pulse-like or pulsated correction voltage at a respective time point when the drive voltage applied to segment electrodes 10 changes in potential level from Vsl to Vsh (see numeral "17" of FIG. 5).

It should be noted that a waveform change or variation of the drive voltage as applied to the segment electrodes 10 occurs due to a change in display data and also a change of alternate current signal (M); however, even if such display data changes randomly, the effective voltage potential will not decrease at a specific location (s). Accordingly, no appreciable degradation in quality of those images being visually displayed on the liquid crystal display panel's screen.

On the other hand, with regard to the display data, in cases where the same one is being constantly displayed, the alternate current signal (M) switches between its H level and L level equally timewise; hence, a waveform change of the drive voltage due to changes of display data will also change between Vsl and Vsh in a half-and-half fashion.

Accordingly, with the illustrative embodiment, it becomes possible, by adding as the correction voltage, a voltage component potentially changes from Vsh to Vsl with a change in potential from Vsl to Vsh, to correct or "amend" both the effective voltage in case the drive voltage's waveform changes due to a display data change from Vsl to Vsh and vice versa.

The embodiment discussed above is arranged to apply the drive voltage Vshh (correction voltage) to one or several segment electrodes 10 when the correction signal stays at H level for on-screen image shadowing correction; most importantly, this is achieved without requiring any extra output stage MOS transistors for applying the drive voltage Vshh.

Figure 9:
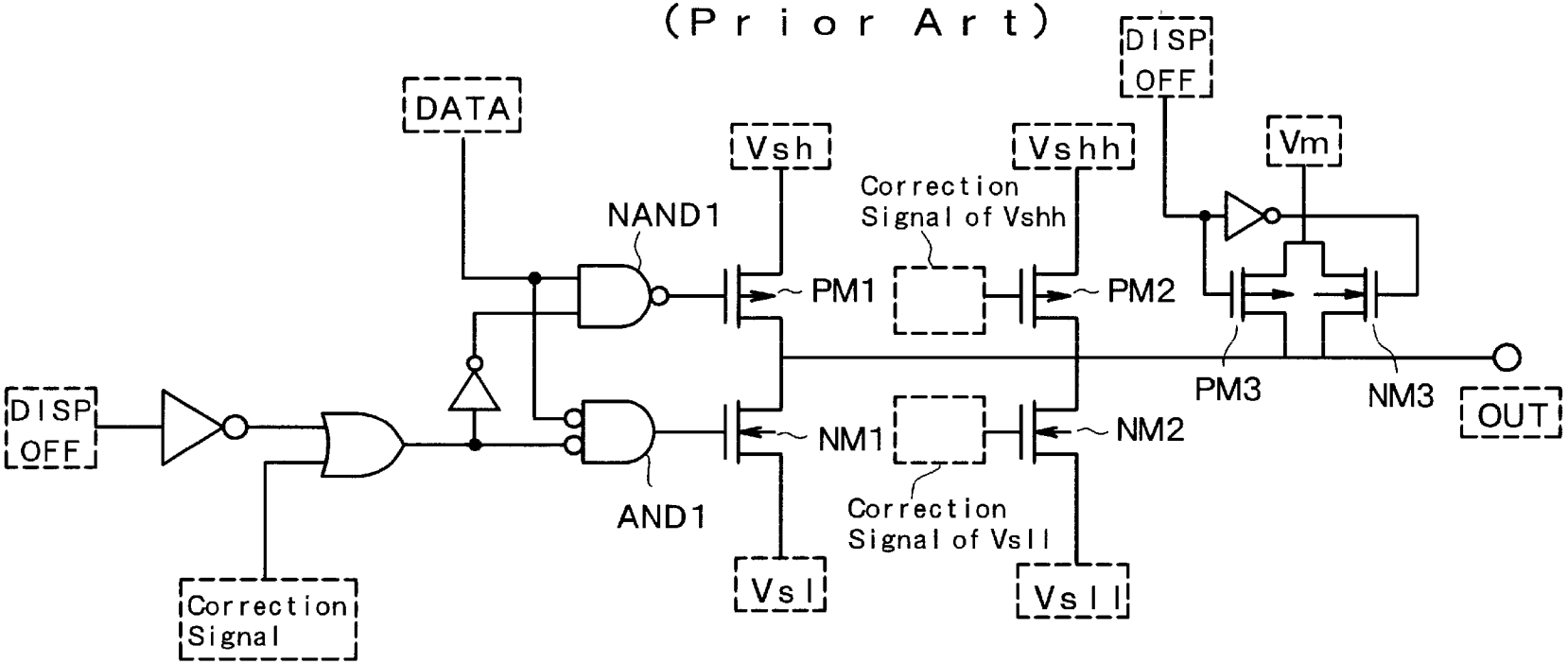
FIG. 9 (Prior Art)
FIG. 9 is a circuit diagram showing an example of prior art circuit configuration for use in correcting or "amending" shadowing that can occur on a display screen due to waveform distortion of a drive voltage being applied to the segment electrode of the liquid crystal display panel.
Figure 12:
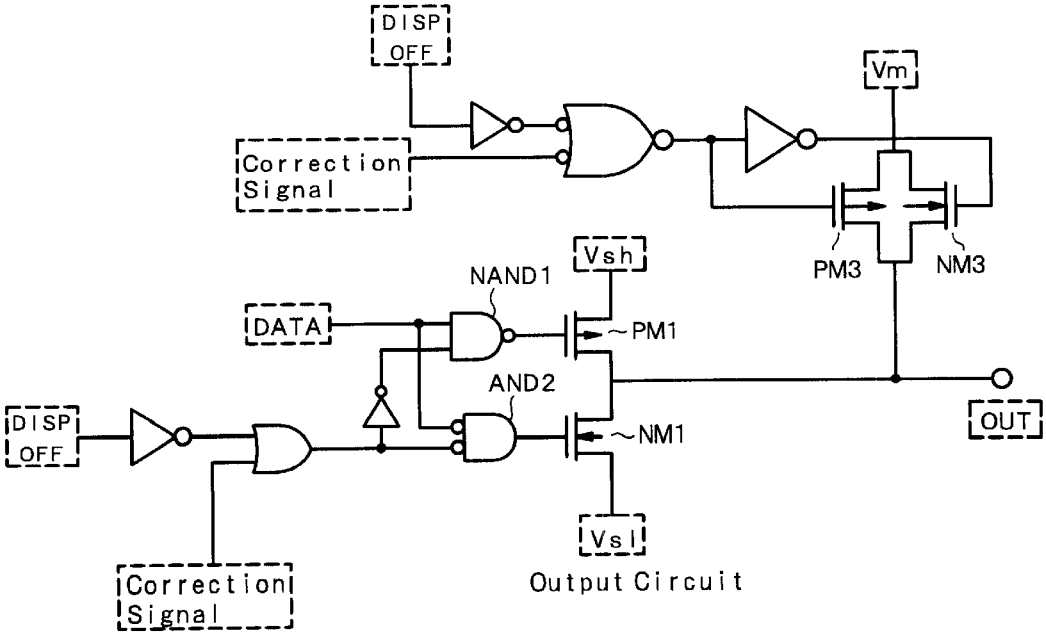
FIG. 12 (Prior Art)
FIG. 12 is a circuit diagram showing another prior art circuit configuration for compensation of shadowing creatable on the display screen due to waveform distortion of a drive voltage as applied to the segment electrode of the liquid crystal display panel.

More specifically, with the embodiment, all the output stage transistors required for the output unit 206 consist only PMOS (PM1), NMOS (NM1), PMOS (PM3) and NMOS (NM3) in a manner similar to the circuitry shown in FIG. 12, which makes it possible to reduce or minimize the requisite area of segment drivers when compared to the segment driver that employs the circuitry of FIG. 9.

Figure 10:
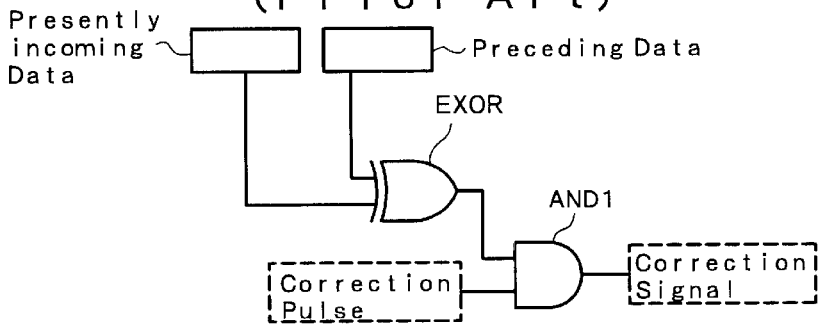
FIG. 10 (Prior Art)
FIG. 10 is a circuit diagram showing a configuration of circuitry for detection of voltage level change time points of a drive voltage being applied to the segment electrode.
Figure 11:
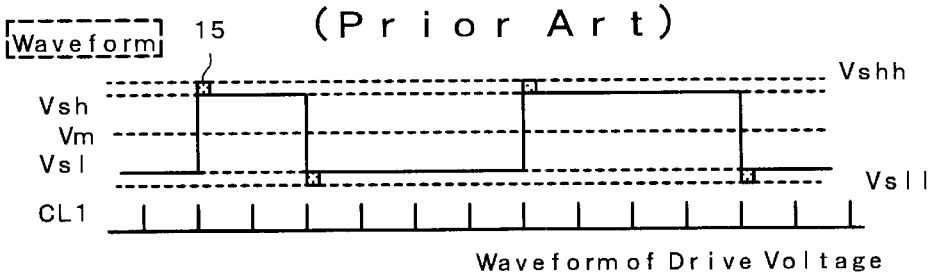
FIG. 11 (Prior Art)
FIG. 11 is a diagram for explanation of a technique for compensation of waveform rounding distortion of a drive voltage as applied to the segment electrode in the circuit configuration shown in FIG. 9.
Figure 13:
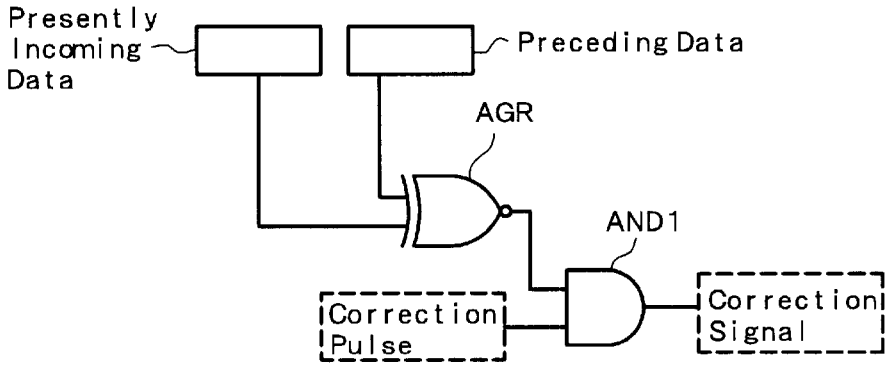
FIG. 13 (Prior Art)
FIG. 13 is a circuit diagram showing a configuration of circuitry for detection of specific time points at which the drive voltage as applied to the segment electrode remains unchanged in potential level.
Figure 14:
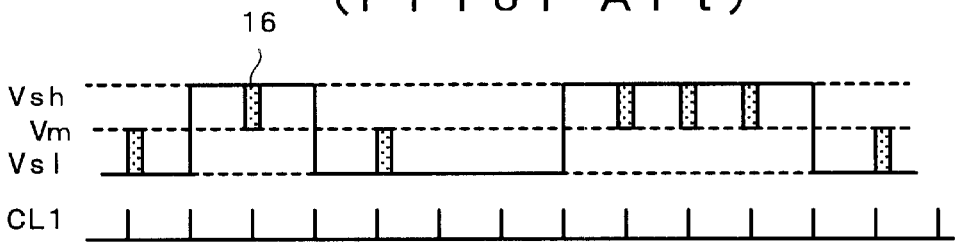
FIG. 14 (Prior Art)
FIG. 14 is a diagram for explanation of a technique for compensating for waveform distortion of a drive voltage as applied to the segment electrode in the circuit configuration shown in FIG. 12.
Figure 15A:
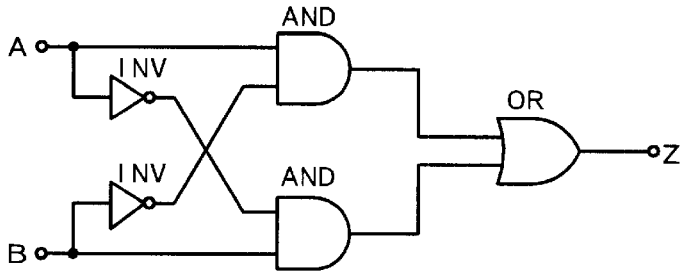
Figure 15B:
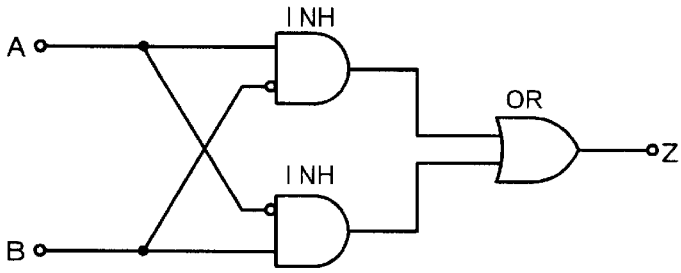
Figure 15C:
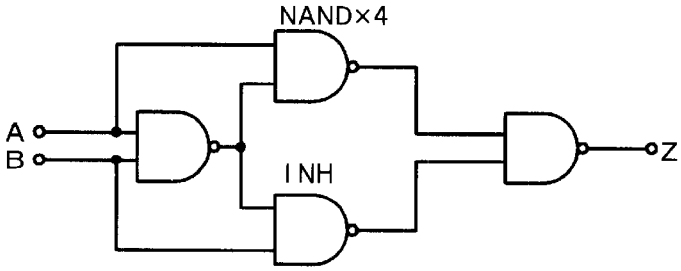
Figure 15D:
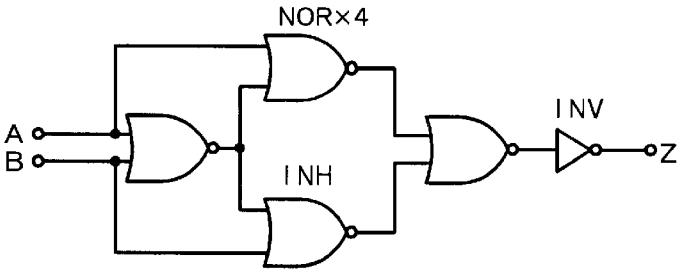

In addition, with the circuitry of FIG. 10, an exclusive logical sum circuit (EXOR) is employed to generate the intended correction signal; in the circuitry shown in FIG. 13, the coincidence circuit (AGR) is used to generate such correction signal.

Generally the exclusive logical sum circuit (EXOR) is configured as an example for a plurality of AND circuits and OR circuit(s) as shown in FIGS. 15A–15D; further, the coincidence circuit (AGR) is typically formed as an exclusive logical sum circuit (EXOR) and its associative circuit for inverting an output of the exclusive logical sum circuit (EXOR).

Consequently the segment driver employing either the circuit shown in FIG. 10 or the circuit shown in FIG. 13 fails so successfully reduce the area of a semiconductor chip or chips constituting such a segment driver as the present invention.

On the contrary, the embodiment is so arranged to make use of only the AND gate (AND1) for generating the correction signal that it reduces or "shrinks" the semiconductor chip area.

It must be noted that although the above-noted embodiment has been explained under an assumption that the present invention is applied to one of STN liquid crystal display modules employing line-sequential or progressive drive methodology, the invention should not be limited only to such embodiment and may also be applicable to STN liquid crystal display modules using active drive methods for selection of multiple lines at a time.

Although the invention herein has been described in detail on the basis of the preferred embodiment for reduction to practice, the invention should not be limited only to the embodiment and may be modified and altered into a variety of forms without departing from the spirit and scope of the invention.

Technical effects and advantages as obtainable by the representative one of those inventions as disclosed herein will be set forth in brief below.

(1) In accordance with the liquid crystal display device incorporating the principles of the present invention, it becomes possible to prevent degradation in quality of display images otherwise occurring due to unwanted rounding distortion of the waveform of any drive voltage or voltages as applied to data lines without having to increase the area of more than one semiconductor chip constituting the data line drive means.

(2) In accordance with the liquid crystal display device of this invention, reducing the area of such semiconductor chip(s) making up the data line drive means makes it possible to manufacture such semiconductor chip (s) at low costs, which in turn enables reduction of product costs accordingly.

What is claimed is:

1. A liquid crystal display device, comprising:

a plurality of scan electrodes;

a plurality of data electrodes opposing said plurality of scan electrodes with a layer of liquid crystal being laid between said plurality of data electrodes and said plurality of scan electrodes;

display elements having said scan electrodes and said data electrodes;

data electrode driver means for applying to said plurality of data electrodes a display data voltage and a non-select voltage plus a correction voltage;

a power supply circuit for supplying said data electrode driver means with said display data voltage and said non-select voltage plus said correction voltage;

a correction pulse generator means for generating more than one correction pulse;

voltage selector means provided in said data electrode driver means for selecting said correction voltage when said display elements are turned on and for selecting said non-select voltage while said display elements are turned off; and voltage application means provided in said data electrode driver means for applying to said data electrodes said correction voltage as output from said voltage selector means within an output period of said correction pulse.

2. The liquid crystal display device according to claim 1, wherein said voltage selector means is operable to select one of said correction voltage and said non-select voltage on the basis of a control signal for controlling turn on and off of said display elements.

3. The liquid crystal display device according to claim 1, wherein said display data voltage corresponds to display data, and wherein said voltage application means applies said correction voltage to said data electrodes when the display data changes from "0" to "1" or from "1" to "0".

4. The liquid crystal display device according to claim 3, further comprising:

a logical product circuit provided in each of said data electrodes for determining of a logical product of a presently available display data and an inverted value of preceding display data as well as a correction pulse as input from said correction pulse generator means and for outputting a correction signal.

5. The liquid crystal display device according to claim 4, wherein said voltage application means applies one of said correction voltage and said non-select voltage to each data electrode on the basis of the correction signal as output from said logical product circuit and a control signal for controlling on and off of said display elements.

6. The liquid crystal display device according to claim 1, wherein a potential difference between said correction voltage and said non-select voltage is greater than a potential difference between said display data voltage and said non-select voltage.

7. A liquid crystal display device, comprising:

a plurality of scan electrodes;

a plurality of data electrodes opposing said plurality of scan electrodes with a liquid crystal layer being disposed between said plurality of data electrodes and said plurality of scan electrodes;

a display panel having said scan electrodes and said data electrodes;

data electrode driver means for outputting toward said plurality of data electrodes a display data voltage and a non-select voltage plus a correction voltage; and voltage selector means provided in said data electrode driver means for selecting said correction voltage and said non-select voltage by a display signal.

8. The liquid crystal display device according to claim 7, wherein said display signal is a control signal for controlling display on and display off of said display panel.

9. The liquid crystal display device according to claim 7, wherein said display data voltage is a voltage corresponding to display data, and said data electrode driver means includes voltage application means, and said voltage application means is operable to apply said correction voltage to said data electrodes when the display data changes from "0" to "1" or from "1" to "0".

10. The liquid crystal display device according to claim 7, wherein said display data voltage is a voltage corresponding to display data, and said data electrode driver means includes a logical product circuit for output of a correction signal through determination of a logical product of a presently generated display data and an inverted value of preceding display data as well as a correction pulse being input from a correction pulse generator means.

11. The liquid crystal display device according to claim 10, wherein said data electrode driver means includes voltage application means, and wherein said voltage application means is for applying to each data electrode one of said correction voltage and said non-select voltage on the basis of said correction signal as output from said logical product circuit and a control signal for control of turn on and off of display elements of said display panel.

12. The liquid crystal display device according to claim 7, wherein a potential difference between said correction voltage and said non-select voltage is greater than a potential difference between said display data voltage and said non-select voltage.

* * * * *